US006616079B1

(12) United States Patent
Leins et al.

(10) Patent No.: US 6,616,079 B1
(45) Date of Patent: Sep. 9, 2003

(54) YARN FEED DEVICE HAVING A FEELER STOP

(75) Inventors: Eberhard Leins, Horb (DE); Richard Kaufmann, Freudenstadt (DE); Hermann Schmodde, Horb-Dettlingen (DE); Gunter Leopold, Baiersbronn (DE)

(73) Assignee: Memminger-IRO GmbH (DE)

( * ) Notice: Subject to any disclaimer, the term of this patent is extended or adjusted under 35 U.S.C. 154(b) by 0 days.

(21) Appl. No.: 10/030,789

(22) PCT Filed: Jul. 6, 2000

(86) PCT No.: PCT/DE00/02207

§ 371 (c)(1),
(2), (4) Date: Jun. 3, 2002

(87) PCT Pub. No.: WO01/04400

PCT Pub. Date: Jan. 18, 2001

(30) Foreign Application Priority Data

Jul. 12, 1999 (DE) ..... 199 32 484

(51) Int. Cl.[7] ..... B65H 51/30

(52) U.S. Cl. ..... 242/365.6; 242/364; 66/132 T; 66/132 R

(58) Field of Search ..... 242/365.6, 364; 66/132 T, 132 R; 226/89

(56) References Cited

U.S. PATENT DOCUMENTS 5,860,298 A 1/1999 Chen

FOREIGN PATENT DOCUMENTS

| | | |
|---|---|---|
| DE | 35 16 891 C1 | 10/1986 |
| FR | 1 029 525 | 6/1953 |
| GB | 1 348 481 A | 3/1974 |
| GB | 2 147 615 A | 5/1985 |

*Primary Examiner*—Kathy Matecki
*Assistant Examiner*—Evan Langdon
(74) *Attorney, Agent, or Firm*—Leydig, Voit & Mayer, Ltd.

(57) ABSTRACT

The yarn feeder of the invention has one or two yarn feeler levers, which monitor the yarn. In order to be able to prevent the monitoring if needed, a feeler barrier is provided. Its actuating device which in the illustrated embodiment is in the form of a handle, is disposed on an outer end of the basic body of the yarn feeder so that it is readily accessible to operators. The position set can also easily be seen from the position of the handle.

13 Claims, 4 Drawing Sheets

YARN FEED DEVICE HAVING A FEELER STOP

FIELD OF THE INVENTION

The invention relates to a yarn feeder, and more particularly, to a yarn feeder for textile machines.

BACKGROUND OF THE INVENTION

Yarn feeders are used to deliver textile yarn to a textile machine, such as a knitting machine or other yarn-using machine. The yarn feeder draws the yarn from a bobbin held on a creel and delivers it to the textile machine at a defined tension and/or in a defined quantity, or furnishes the yarn under defined conditions. Textile machines to which a plurality of yarns are to be supplied simultaneously usually have a plurality of yarn feeders. In medium-sized circular knitting machines, for instance, about 100 yarn feeders per knitting machine are provided. To that end, the machine has an annular retainer on which the yarn feeders can be secured. The yarn feeders then protrude in rays outwardly from the retainer and are disposed closely together.

Yarn feeders of this design often require a yarn feeler lever so that proper and correct yarn feeding can be monitored.

From German Patent DE 3516891 C1, for instance, a yarn feeder for textile machines is known that has a yarn guide drum driven to rotate about a vertical axis. The arriving yarn is guided onto the yarn guide drum, wraps around it several times, and then leads away from it. Both upstream and downstream of the yarn guide drum, a pivotably supported yarn feeler lever rests on the yarn and is held by the yarn in a pivoted position. If the yarn breaks, or if the yarn tension drops markedly, the lever drops downwardly, which is interpreted as an indication of an undesired state.

For drawing in yarns or on startup or in a sampling mode or slow-motion operation, it may be necessary to stop operation of the yarn feeler levers.

A similar yarn feeder is known from U.S. Pat. No. 5,860,298. It has a basic body which is provided on one end with a fastening device for securing to a retainer of a textile machine. A vertically disposed shaft is rotatably supported on the basic body and carries a yarn guide drum on its lower end. On its upper end, the shaft is connected to pulleys acting as a drive device. The yarn is guided via the yarn guide drum by yarn guide elements, which define a yarn travel path. The yarn travel path begins at the end of the basic body remote from the fastening device and leads via the yarn guide drum to an end on the outlet side; this end being located near the fastening device. Yarn guide levers for monitoring the yarn are pivotably disposed upstream and downstream of the yarn guide drum and rest on the yarn.

When a yarn is drawn in, care must be taken that it be threaded in correctly beneath the yarn feeler levers.

OBJECTS AND SUMMARY OF THE INVENTION

It is an object of the present invention to provide a yarn feeder whose construction and operation is more simplified and reliable.

A yarn feeder according to the invention has at least one but preferably a plurality of yarn feeler levers. To that end, a feeler barrier is provided for shifting the yarn feeler lever into a passive state as needed. This can be obtained either alternatively or cumulatively by two procedures. One is shifting the yarn feeler lever to a passive position when the feeler barrier is actuated, and another is shutting off the yarn feeler lever, or in other words interrupting a signal path connected to the yarn feeler lever, upon actuation of the feeler barrier. If the yarn feeler lever is raised upon actuation of the feeler barrier, for instance, then the yarn can be threaded in more easily, and in the ensuing startup or sampling mode (including a slow-motion mode), any sagging of the yarn will not cause the applicable signal to be generated. The yarn feeler lever is passive. This makes operation markedly easier.

The feeler barrier is manually actuatable and is formed by a slide or by a rotatable or pivotable element. A handle is used for actuation, which is disposed on an outer end of the basic body that is easily accessible to an operator in the installed state. If the yarn feeders are to be disposed, for example, on a fastening ring of a circular knitting machine, from which they protrude radially outward, then the disposition of the handle on the end of the basic body remote from the fastening device permits manual access without hindrance, and the position of the feeler barrier can be seen from outside. In this way, an operator can easily gain an overview of the status of the yarn feeder. Furthermore, operation in which all the feeler barriers, for instance, of all the yarn feeders (as a rule about 100 of them) have to be actuated, is made considerably easier.

The yarn feeder has a yarn travel path that extends from a yarn inlet to a yarn outlet. The handle of the feeler barrier is preferably disposed in the vicinity of the yarn inlet. Generally, this also is where other devices are disposed, such as a yarn brake, knot catcher or the like that require occasional visual inspection or manual access. The operating stations of the yarn feeder are thus concentrated in one region.

The handle may be disposed on the flank of the yarn feeder and specifically on the end of it remote from the fastening device. To that end, a handle recess or some other indentation may be formed in the basic body, which is preferably is formed as a housing. The handle may be visible and accessible in this recess. In addition, it may be connected to or provided with a signaling device, which makes it easier to detect the position of the feeler barrier. By way of example, the signaling device may be a colored slide or the like.

The feeler barrier preferably has, or is formed by, a barrier element, and the barrier element preferably is displaceably supported. The handle can be rigidly joined to the barrier element. This makes for an especially simple, sturdy construction. The barrier element can then be accommodated virtually completely in an interior of the basic body. Still other elements, such as switches, detent means for resiliently defining the position of the barrier element, and the like, can also be accommodated here.

The yarn feeder may have a plurality of yarn feeler levers, which preferably are influenced successively by the feeler barrier. The feeler barrier then successively pivots the yarn feeler levers into the passive position and thus shuts them off in succession. Thus individual yarn feeler levers, such as the yarn feeler lever on the outlet side, can be switched to be passive, in order upon machine startup to activate the yarn feeler on the inlet side for monitoring for yarn breakage, yet allowing brief excessive feed quantities on the outlet side.

Other objects and advantages of the invention will become apparent upon reading the following detailed description and upon reference to the drawings, in which:

Figure 1:
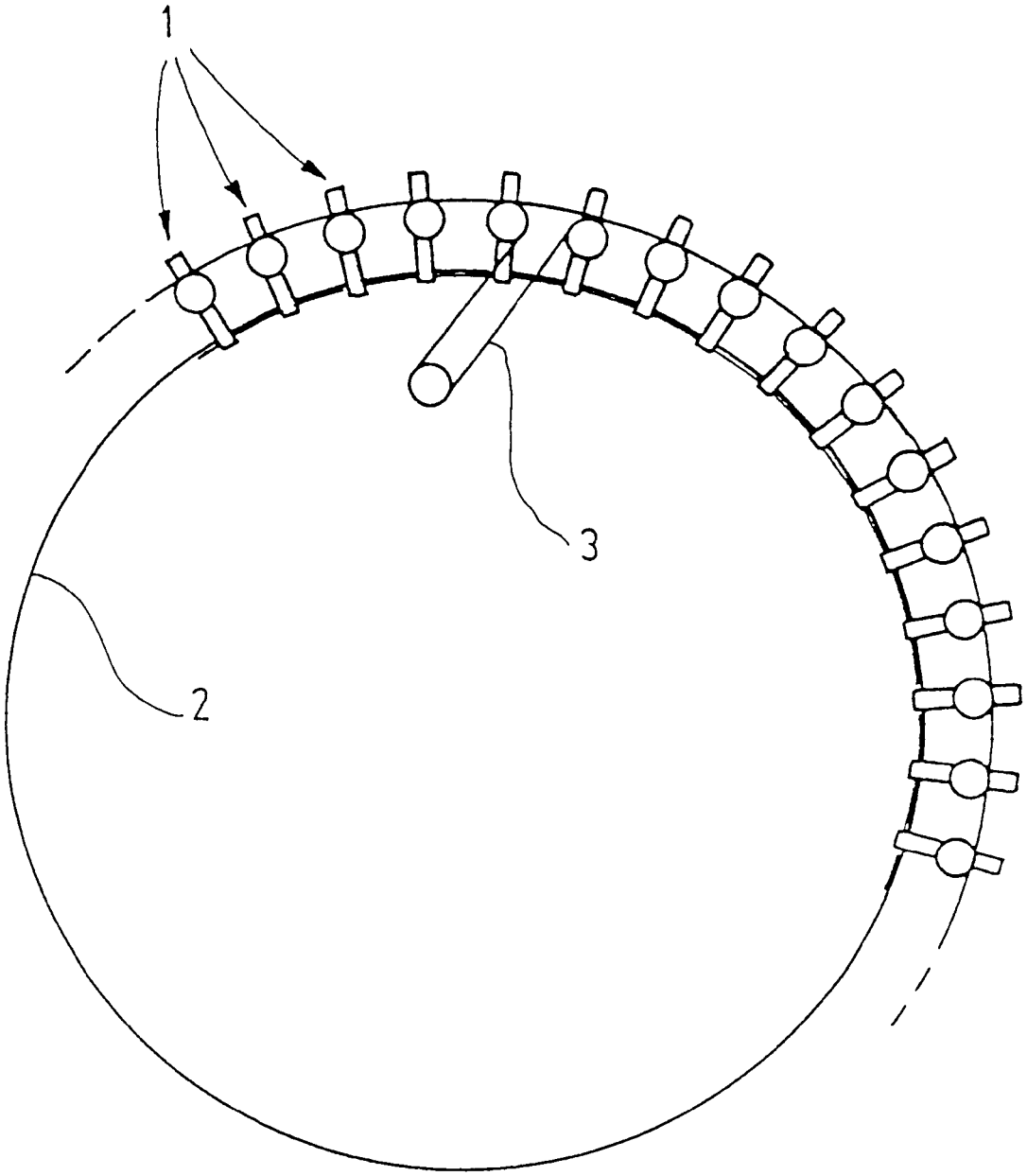
FIG. 1 is a schematic fragmentary top plan view of a group of yarn feeders disposed on a ring-like retainer.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

The yarn feeder 1 has an elongated basic body 3, which is formed by a two-shell housing with an upper part 4 and a lower part 5. On the end of the body 3 that in the installed position on the retaining ring two points radially inwardly, the basic body 3 is provided with a fastening device 6, which is formed by a jaw 7, opening downwardly, on which a clamping screw is provided. In the region of the jaw 7, the housing parts (upper part 4 and lower part 5) fit over one another to provide mutual bracing.

A shaft is rotatably supported on the basic body 3, and its lower end carries a yarn guide drum 8. Disposed on its upper end are two pulleys 9, 10, which are supported rotatably on the shaft. For coupling, as required, either the pulley 9 or the pulley 10 to the shaft, a coupling disk 11 is used, which is supported in axially displacement on the shaft.

The yarn guide drum 8 is disposed in a yarn travel path that is defined by yarn guide elements. These include a yarn inlet eyelet 14, which is open on one end, a yarn guide eyelet 15 structurally connected to the housing and located upstream of the yarn guide drum 8, and a yarn guide eyelet 16 and an open yarn outlet eyelet 17 adjoining the yarn guide drum 8. As needed, the yarn guide eyelet 16 can be closed by a resilient tongue 18 to make it easier to put a yarn in place.

A yarn brake 21, which has two break disks 22, 23 urged magnetically or in other ways toward one another preferably is disposed between the yarn inlet eyelet 14 and the yarn guide eyelet 15. The brake disks are retained for lateral and rotatable movement in a bearing device 24. They clamp a continuous yarn 25 resiliently between them.

Two yarn feeler levers 27, 28 are pivotably supported on the basic body 3 of the yarn feeder 1. The yarn feeler lever 27 is disposed on the inlet side and is constructed in the form of a hoop. It has a yarn feeler part 31, joining the two legs of the hoop to one another, that rests on the yarn 25 and that in a raised position held up by the yarn is located between the yarn brake 21 and the yarn guide eyelet 15. If it is not held up by the yarn 25, then it can pivot downward by its own weight or by spring loading or spring reinforcement.

The yarn feeler lever 28 also is in the form of a hoop and on its lower end, joining the two legs of the hoop to one another, it has a yarn feeler part 32. This part rests on the yarn 25 and is kept in the raised position by the yarn. If the yarn tension decreases, or if the yarn 25 forms a sagging loop, then the yarn feeler lever 28 sags downward under the influence of its own weight and/or with spring reinforcement.

Figure 2:
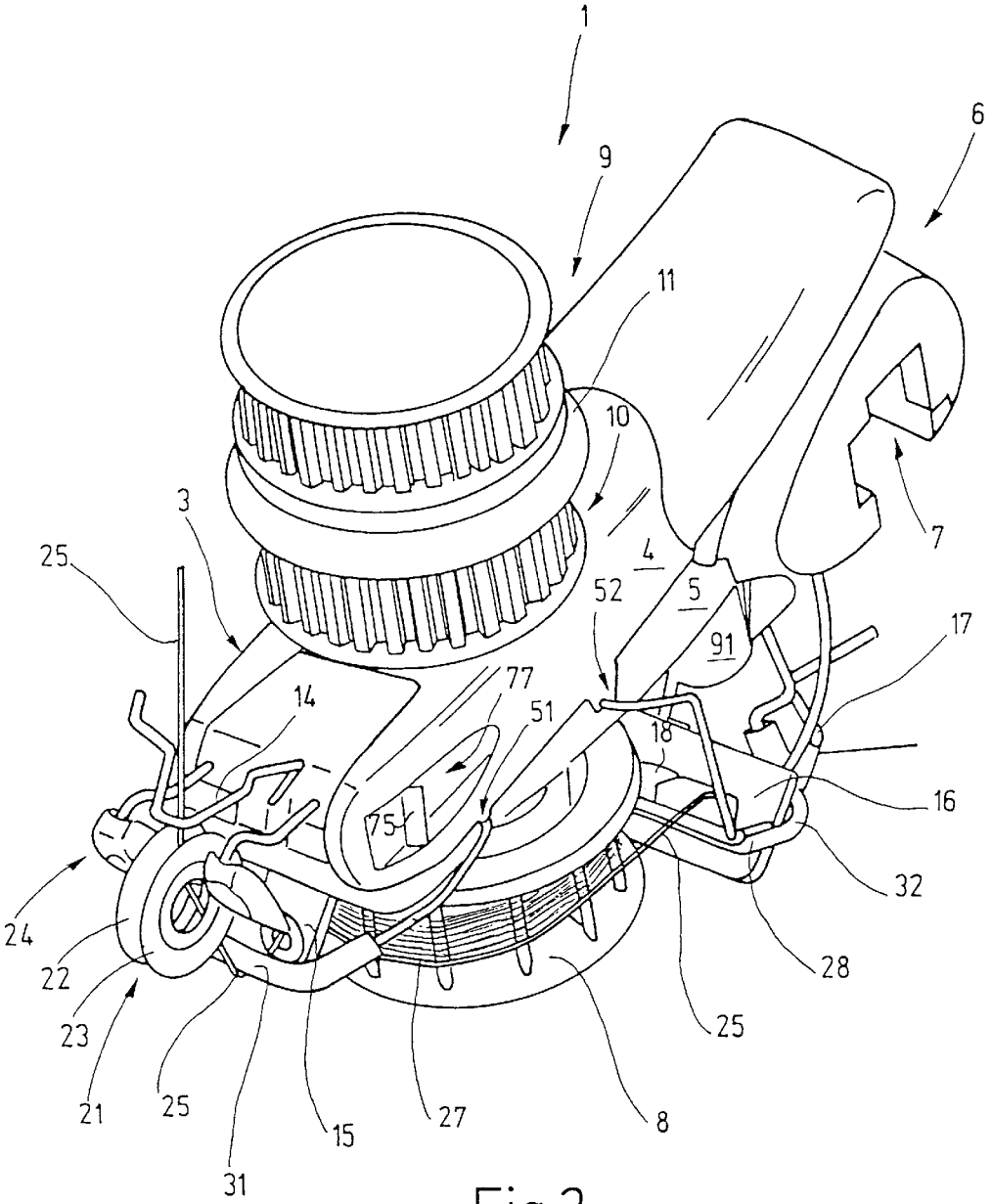
FIG. 2 is a perspective of one of the illustrated yarn feeders, as depicted in FIG. 1, and embodying the present invention.
Figure 3:
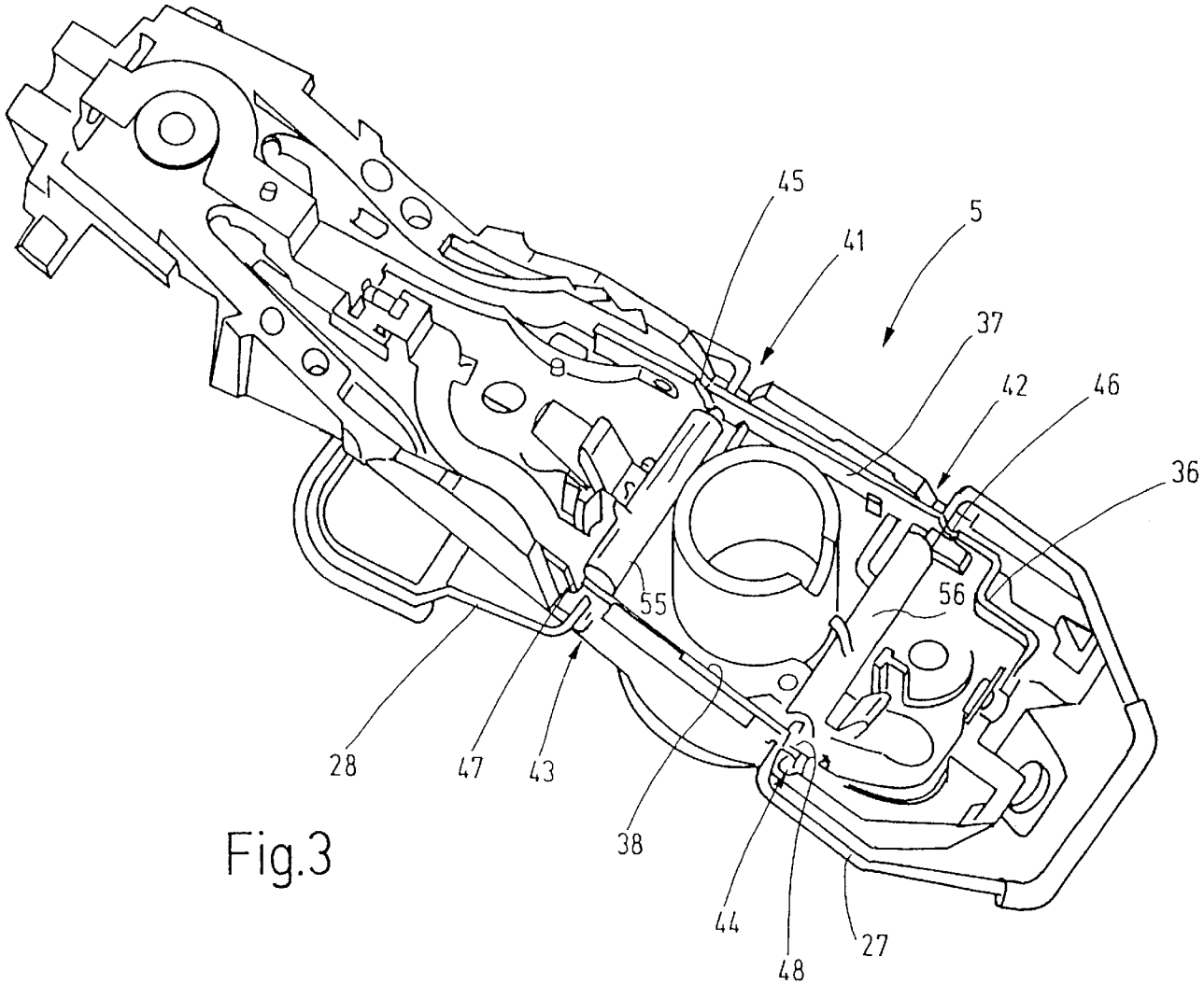
FIG. 3 is a perspective of a housing part of the yarn feeder shown in FIG. 2.
Figure 4:
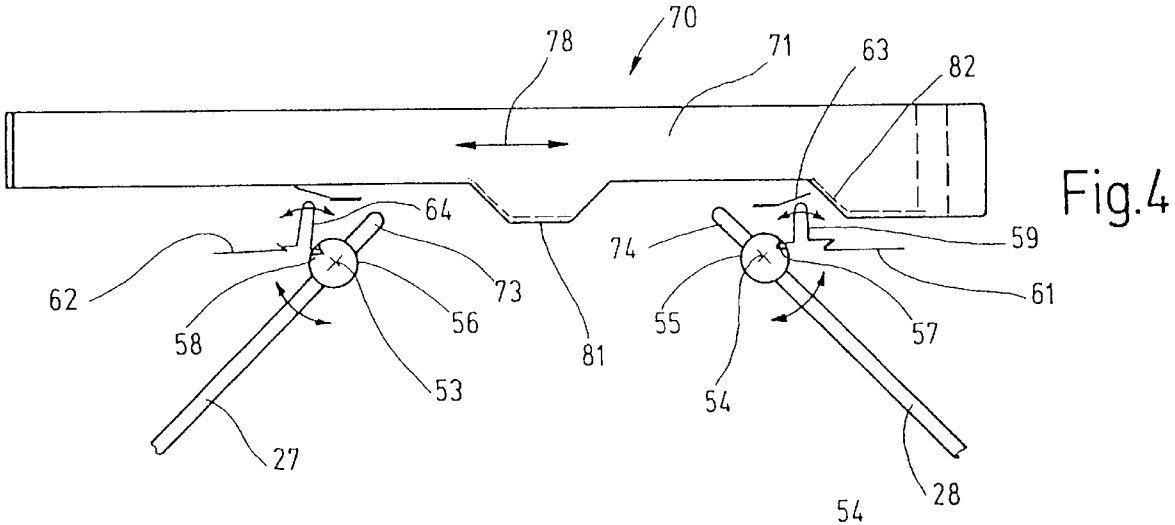
FIG. 4 is a depiction of two yarn feeler levers and one feeler barrier of the yarn feeder shown in FIG. 2.
Figure 5:
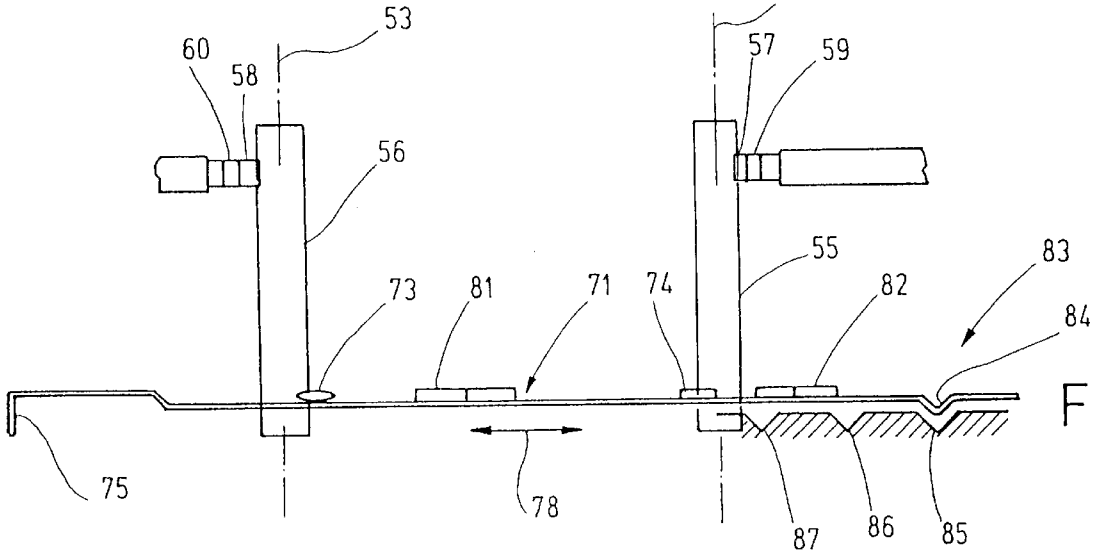
FIG. 5 is a partially schematic plan view of the feeler barrier with associated elements for the yarn feeder shown in FIG. 2.

To enable shifting the yarn feeler levers 27, 28 into a raised passive position as needed, a feeler barrier, which can be seen particularly from FIGS. 4 and 5, is disposed on the yarn feeder 1. As seen first from FIG. 3, a hoop 36 connected electrically to ground is disposed in the lower housing part 5. The hoop 36 in this instance is formed by a suitable sheet-metal strip bent nearly into a U-shape. Its two legs 37, 38 extend inward approximately parallel to one another along both housing walls that face one another in the form of flanks. In the immediate vicinity of trapezoidal cutouts 41, 42, 43, 44 provided in the side walls of the housing part 5, the legs 37, 38 of the hoop 36 are provided with L-shaped notches 45, 46, 47, 48, which form bearing points for inwardly-bent ends of the hoop-like yarn feeler levers 27, 28. For securing these ends of the yarn feeler levers 27, 28 in the bearing points or positions, the upper housing part 4, as shown in FIG. 2, is provided with protrusions 51, 52, which fit into the trapezoidal cutouts 41, 42, 43, 44 and on their face end have a half-round recess for defining the pivot axes 53, 54 (FIG. 4) of the yarn feeler levers 27, 28.

Between the inwardly bent ends of the yarn feeler levers 27, 28, roller-like plastic parts 55, 56 are provided, which join together the ends of the legs of each yarn feeler lever 27, 28 that point to one another. The plastic parts 55, 56 are disposed approximately concentrically to the respective pivot axis 53, 54 and act as switch actuating elements. They each have a slit-like recess 57, 58 of triangular cross section extending approximately parallel to the respective pivot axis 53, 54, in which recess an outwardly-bent free end of one leg of a respective U-shaped spiral spring 59, 60 is seated. The other leg of each spiral spring 59, 60 has an outwardly-bent end supported on an abutment, which is formed by a contact cleat 61, 62. The spiral springs 59, 60 serve to relieve the weight of the yarn feeler levers 27, 28 and in addition serve as switch elements. To that end, resilient contact tongues 63, 64 are provided, which protrude into the pivoting range of the end of the U-shaped springs 59, 60 at which the legs are joined.

The barrier element 71 is formed by a substantially flat sheet-metal strip or slide, on which a tab or handle 75 is bent at one end at a right angle (FIG. 5). As shown in FIG. 2, this tab is disposed in a handle recess 77 formed laterally on the end of the basic body 3 remote from the fastening device 6. The tab serves to push the barrier element 71 back and forth longitudinally, as indicated by arrow 78 and FIGS. 4 and 5, in order to block and release the yarn feeler levers 27, 28.

The barrier element 71 has a first control face 81, associated with the yarn feeler lever 27, and a second control face 82, associated with the yarn feeler lever 28. The control faces 81, 82 are oriented at an acute angle to the direction of displacement of the barrier element 71 and are aligned such that they press the lugs or protrusions 73, 74 of the yarn feeler levers 27, 28 downwardly whenever they come into engagement with them. The spacing between the control faces 81, 82 deviates from the spacing between the lugs 73, 74 so that, for examples (if the spacing at the barrier element 71 is less) the control face 82 first comes into contact with the lug 74 and then the control face 81 comes into contact with the lug 73. The control faces 81, 82 preferably are initially ramp-like and then change into a retaining portion oriented parallel to the displacement direction 78. The control faces 81, 82 are preferably formed by portions bent laterally away from the barrier element 71.

The barrier element 71 preferably can be locked in a plurality of displacement positions. This purpose is accomplished by a detent device 83, which is formed by a lug 84 protruding laterally away from the barrier element 71 and by one or more recesses 85, 86, 87 in the housing wall toward the barrier element 71. The lug 84 is preferably is formed on the laterally resilient end, remote from the handle 75 of the barrier element 71. The notches or recesses 85, 86, 87 in the housing wall are disposed such that when the lug 84 is seated in the first recess 85, neither control face 81, 82 is in contact with either of the lugs 73, 74. If the lug 84 engages the second recess 86, then the control face 82 has already pressed the lug 84 downward and thus the yarn feeler lever 28 upward. If the lug 84 has snapped into the third recess 87, then in the meantime the second control face 81 also has advanced the yarn feeler lever 27 upwardly.

Alternatively, instead of the slide acting as a barrier element 71, a pivotable element can be used, such as a lever, or a shaft or tube that is rotatable about its longitudinal axis. These elements may likewise be provided with barrier slots or barrier elements.

The yarn feeder 1 described above functions as follows:

Once all the yarn feeders 1 are secured to the retaining ring 2, then a yarn is first brought to each yarn feeder 1. To enable easy introduction of the yarn into the respective yarn feeder 1, the feeler barriers 70 are first actuated, in that the handles 75 of all the yarn feeders 1 are actuated or in other words are pulled radially outward with respect to the fastening ring 2. The yarn feeler levers 27, 28 pivot upwardly in the process. The yarn feeler part 31 of the yarn feeler lever 27 pivots upwardly between the brake 21 and the yarn inlet eyelet 15. The yarn feeler part 32 pivots upwardly between the yarn guide eyelet 16 and the yarn outlet eyelet 17. Once all the yarns have been put in place, the knitting machine can be started up cautiously, in slow motion. If needed, to that end the inlet-side yarn feeler levers 27 can be converted from their passive to the active state or in other words released. To that end, the various handles 75 of the barrier elements 71 are thrust radially inwardly somewhat (by one stage) so that the respective lug 84 moves out of the recess 87 (FIG. 5) and snaps into the recess 86. This can be accomplished with all the yarn feeders 1. The machine can then be operated in this condition until all the yarns are traveling properly. Once that state is attained, then by further pushing the handles 75 of the yarn feeders 1 radially inwardly, the respective outlet-side yarn feeler levers 28 can also be released. Now, both yarn feeler levers 27, 28 of each yarn feeder 1 are active.

What is claimed is:

1. A yarn feeder (1) particularly adapted for mounting and use in a textile machine, comprising:

an elongated body (3) having a fastening device (6) at one end for securing the yarn feeder (1) to a retaining device (2) of a textile machine, yarn guides (14, 15, 16, 17) supported on the body (3) for defining a yarn travel path, a yarn guide drum (8) disposed in the yarn travel path, said drum being rotatably mounted on the body (3) and having a drive device (9), at least one yarn feeler lever (27) disposed in the yarn travel path, said yarn feeler lever (27) being pivotably supported on the body (3) and in an active state rests on a yarn (25) being fed by the yarn feeder, a feeler barrier (70) for selectively shifting the yarn feeler lever (27) to a passive inoperable state, and said feeler barrier (70) having an operating handle (75) disposed on the feeler barrier and being accessible from an end of the elongated body (3) remote from the fastening device (6).

2. The yarn feeder of claim 1 in which said feeler barrier (70) and handle (75) are rigidly joined to one another.

3. The yarn feeder of claim 1 in which said feeler barrier (70) includes a barrier element (71) supported for movement back and forth between a locking position in which the yarn feeler lever (27) is maintained in a position of repose in said passive state, and a release position which leaves the yarn feeler lever (27) unaffected by the barrier element (71) and free to assume an active state on a yarn being fed by the yarn feeder.

4. The yarn feeder of claim 3 which said barrier element (71) has a barrier face (81) that is engageable with the yarn feeler lever (27) upon displacement of the barrier element to a barrier position for shifting the yarn feeler lever (27) to said position of repose.

5. The yarn feeder of claim 1 in which said feeler barrier (70) has a plurality of detents (83) for locking the feeler barrier (70) in any one of a plurality of selected positions.

6. The yarn feeder of claim 5 in which said retaining device surrounding a textile machine with which the yarn feeder is used, is mountable on a circular mounting member, and said detents can be observed by an operator at one end of the yarn feeder looking radially toward the textile machine.

7. The yarn feeder of claim 5 in which said feeler barrier (70) includes an elongated barrier element (71), and said handle is formed by a tab protruding laterally of the barrier element and transversely to the direction of movement of the feeler barrier element (70).

8. The yarn feeder of claim 5 in which said handle (75) is disposed in an indentation (77) formed in the body.

9. The yarn feeder of claim 1 including a yarn brake (21) disposed in the yarn travel path, and said handle (75) being disposed beside the yarn brake (21).

10. The yarn feeder of claim 1 in which said feeler barrier (70) includes an electric switch (60, 64, 59, 63) actuatable in response to movement of the feeler lever (27).

11. The yarn feeder of claim 1 including a switch for detecting the position of the barrier element (71).

12. The yarn feeder of claim 1 including a plurality of yarn feeler levers (27, 28), and said feeler barrier (70) is operative for controlling the passive state of each of the feeler levers (27, 28).

13. The yarn feeder of claim 12 in which said feeler barrier (70) is operable for successively controlling the passive state of said plurality of yarn feeler levers (27, 28).

* * * * *